US005166016A

United States Patent [19]

Badesha et al.

[11] Patent Number: 5,166,016

[45] Date of Patent: Nov. 24, 1992

[54] PHOTOCONDUCTIVE IMAGING MEMBERS COMPRISING A POLYSILYLENE DONOR POLYMER AND AN ELECTRON ACCEPTOR

[75] Inventors: Santokh S. Badesha; Michael M. Shahin, both of Pittsford; Damodar M. Pai, Fairport, all of N.Y.

[73] Assignee: Xerox Corporation, Stamford, Conn.

[21] Appl. No.: 738,779

[22] Filed: Aug. 1, 1991

[51] Int. Cl.[5] ..... G03G 5/043

[52] U.S. Cl. ..... 430/56; 430/58; 430/71; 430/72; 430/83

[58] Field of Search ..... 430/56, 58, 62, 83, 430/96, 72, 71

[56] References Cited

U.S. PATENT DOCUMENTS

| | | | |
|---|---|---|---|
| 3,484,237 | 12/1969 | Shattuck et al. | 96/1.5 |
| 4,356,246 | 10/1982 | Tabei et al. | 430/136 |
| 4,544,729 | 10/1985 | Nate et al. | 528/28 |
| 4,559,287 | 12/1985 | McAneney et al. | 430/59 |
| 4,618,551 | 10/1986 | Stolka et al. | 430/58 |
| 4,758,488 | 7/1988 | Johnson et al. | 430/59 |
| 4,772,525 | 9/1988 | Badesha et al. | 430/58 |
| 4,774,159 | 9/1988 | Stolka et al. | 430/58 |
| 4,855,201 | 8/1989 | Badesha et al. | 430/58 |
| 4,917,980 | 4/1990 | Badesha et al. | 430/58 |
| 4,933,244 | 6/1990 | Teuscher et al. | 430/58 |
| 4,994,566 | 2/1991 | Mimura et al. | 540/141 |

*Primary Examiner*—Marion E. McCamish
*Assistant Examiner*—Rosemary Ashton
*Attorney, Agent, or Firm*—E. O. Palazzo

[57] ABSTRACT

A photoconductive imaging member comprised of a supporting substrate and thereover a charge transfer complex comprised of a polysilylene donor polymer and an electron acceptor.

17 Claims, 1 Drawing Sheet

PHOTOCONDUCTIVE IMAGING MEMBERS COMPRISING A POLYSILYLENE DONOR POLYMER AND AN ELECTRON ACCEPTOR

BACKGROUND OF THE INVENTION

This invention is generally directed to photocoductive imaging members, and more specifically to imaging members comprised of a supporting substrate and in contact therewith a layer that functions both as a photogenerator, and a charge transport layer. The present invention in one embodiment is directed to layered imaging members comprised of a supporting substrate and a single layer comprised of a charge transfer complex of a polysilylene, reference U.S. Pat. No. 4,618,551, the disclosure of which is totally incorporated herein by reference, and an electron acceptor, such as butyl-9-dicyanomethylenefluorene-4-carboxylate (BCMF). In a specific embodiment, the present invention relates to layered imaging members comprised of a blocking layer and a single layer of the charge transfer complex.

The imaging members of the present can be selected for a number of known imaging, especially xerographic, and printing processes including electrophotographic imaging and printing processes.

The formation and development of electrostatic latent images on the imaging surfaces of photoconductive materials by electrostatic means is well known. Numerous different photoconductive members for use in xerography are known such as selenium, alloys of selenium, layered imaging members comprised of aryl amine charge transport layers, reference U.S. Pat. No. 4,265,990, and imaging members with charge transport layers comprised of polysilylenes, reference U.S. Pat. No. 4,618,551. The disclosures of the aforementioned patents are totally incorporated herein by reference. With the aforementioned imaging members, especially those of the '551 patent, there are selected layered imaging members with a polysilyelene transport layer. In U.S. Pat. No. 4,474,865, the disclosure of which is totally incorporated herein by reference, there are illustrated layered imaging members comprised of a photogenerating layer overcoated with an electron transport layer comprised, for example, of derivatives of 9-fluorenylidine dispersed in an inactive resin binder.

There are illustrated in U.S. Pat. No. 3,484,237, the disclosure of which is totally incorporated herein by reference, charge transfer complexes of poly-N-vinylcarbazole (PVK), and 2,4,7-trinitro-9-fluorenone (TNF) for photoconductive imaging members. Also, in U.S. Pat. No. 4,559,287, the disclosure of which is totally incorporated herein by reference, imaging members with a fluorenylidene electron transport layer dispersed in a resin binder and having incorporated therein a stabilizing amount of an aryl amine electron donating compound. Other U.S. Pat. Nos. illustrating layered imaging members include 4,772,525; 4,758,488; 4,774,159; 4,822,703; 4,839,451 and 4,917,980, the disclosures of which are totally incorporated herein by reference. In a patentability search report, the following U.S. Patents are recited: U.S. Pat. No. 4,356,246 which discloses electrophotographic materials with a noncrystalline silicon powder, see the Abstract; also note Examples 5 and 10 of this patent; in Example 5 there is disclosed dissolving in the obtained photoconductive composition 2,4,7-trinitro-9-fluorenone (TNF) as a charge carrier; and a collection of polysilylene patents U.S. Pat. Nos. 4,544,729; 4,618,551; 4,758,488; 4,772,525; 4,774,159; 4,855,201 and 4,917,980.

SUMMARY OF THE INVENTION

It is therefore a feature of the present invention to provide layered photoresponsive imaging members with many of the advantages indicated herein.

It is a feature of the present invention to provide layered photoconductive imaging members comprised of a single layer that functions as a photogenerator, and a charge transport medium.

In a further feature of the present invention there is provided a layered photoresponsive imaging member with a single photogenerating charge transport layer in contact with a supporting substrate.

In another feature of the present invention there is provided a layered photoresponsive imaging member with a single photogenerating charge transport layer in contact with a blocking layer situated on a supporting substrate.

In another feature of the present invention there is provided a layered photoresponsive imaging member with a single photogenerating charge transport layer in contact with an adhesive layer, and a blocking layer situated on a supporting substrate.

In another feature of the present invention there is provided an ambipolar layered photoresponsive imaging member that can be effectively discharged after initial charging to either a positive or a negative polarity.

In another feature of the present invention there are provided imaging and printing methods with the layered imaging members disclosed herein.

Another feature of the present invention resides in the provision of imaging members with electrical stability for an extended number of imaging cycles, for example exceeding 50,000 in some instances.

These and other features of the present invention can be accomplished in embodiments thereof by the provision of layered imaging members comprised, for example, of a single photogenerating layer and a charge transport layer. More specifically, the present invention is directed to layered photoconductive imaging members comprised of a supporting substrate and thereover a single layer comprised of a charge transfer complex. In one embodiment, the charge transfer complex is comprised of a donor polymer, such as a polysilylene, reference U.S. Pat. No. 4,618,551, the disclosure of which is totally incorporated herein by reference, and an electron acceptor comprised of a fluoronylidene methane, reference U.S. Pat. No. 4,559,287, the disclosure of which is totally incorporated herein by reference.

Examples of donor or hole transporting polymers include poly(methyl phenyl) silylene, poly(n-propylmethylsilylene-co-methylphenylsilylene), poly(methylphenylsilylene-co-dimethylsilylene), poly(cyclohexylmethylsilylene), poly(diphenylsilylene-co-methylphenylsilylene), poly(cyclotetramethylenesilylene), poly(paratolylmethylsilylene), poly(n-butylmethylsilylene), poly(n-propylmethylsilylene), and the like.

Examples of electron transporting acceptors include (4-n-butoxycarbonyl-9-fluorenylidene) malononitrile, (4-n-butoxycarbonyl-9-fluorenylidene)malononitrile, (4-n-phenethoxycarbonyl-9-fluorenylidene)malononitrile, (4-carbitoxy-9-fluorenylidene)malononitrile, (4-n-butoxycarbonyl-2,7-dinitro-9-fluorenylidene)malononitrile, 3,5-dimethyl-3',5'-tertiarybutyl-4,4'-diphenoquinone, 3,5-diethyl-3',5'-tertiarybutyl-4,4'-diphenoquinone, and the like.

The single layer can be prepared by admixing and reacting in, for example, a flask from about 10 to about 90 parts of the donor polymer, and from about 90 to about 10 of the electron acceptor, followed by heating at a temperature, for example, of from between about 80° and about 100° C. The colored solution resulting, light orange in embodiments, can then be cooled to room temperature, for example, about 25° C., followed by the coating thereof on, for example a supporting substrate to enable an imaging member after drying. The thickness of the coating can vary, generally, however, the coating after drying is of a thickness of from between about 5 and about 40, and preferably from between about 10 to about 25 microns as measured by known means such as, for example, a Permscope.

The photoresponsive imaging members of the present invention can be prepared by a number of known methods, the process parameters and the order of the coating of the layers being dependent on the member desired. Thus, for example, the photoresponsive members of the present invention can be prepared by providing a conductive substrate and applying thereto the single photogenerating charge transport layer coated on a blocking layer. The blocking layer can be comprised of a number of known blocking components, including insulating polymers, such as N-methyl-3-aminopropyltriethoxy silane, in an effective thickeness of, for example, from between about 0.01 to about 0.2 micron. The photoresponsive imaging members of the present invention can be fabricated by common known coating techniques such as by dip coating, draw-bar coating, or by spray coating process, depending mainly on the type of imaging devices desired. The single coating can be dried, for example, in a convection or forced air oven at a suitable temperature.

DETAILED DESCRIPTION OF THE INVENTION

Figure 1:
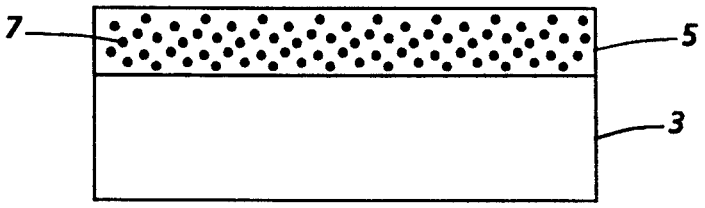
FIG. 1 represents a photoresponsive imaging member of the present invention.

Illustrated in FIG. 1 is a photoresponsive imaging member of the present invention comprising a supporting substrate 3 of a thickness of from about 50 microns to about 5,000 microns, and thereover a single layer 5 of a thickness of from between about 5 microns to about 25 microns comprised of a charge transfer complex of a donor polysilylene polymer, and an electron acceptor 7.

Figure 2:
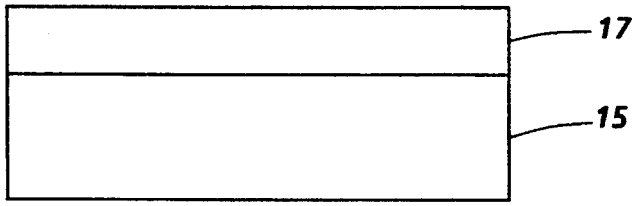
FIG. 2 represents photoresponsive imaging members of the present invention.

Illustrated in FIG. 2 is a photoresponsive imaging member of the present invention comprised of about a 25 micron to about a 100 micron thick conductive supporting substrate 15 of aluminized MYLAR®, a 5 micron to about a 25 micron thick single photogenerating layer-charge transport layer 17 comprised of a charge transfer complex of polysilylene, such as polymethyl phenyl silylene, and an electron acceptor, such as 4-n-butoxycarbonyl-9-fluorenylidene malononitrile.

The supporting substrate layers may be opaque or substantially transparent and may comprise any suitable material possessing, for example, the requisite mechanical properties. The substrate, many of which are known, may comprise a layer of an organic or inorganic material having a conductive surface layer arranged thereon or a conductive material such as, for example, aluminum, chromium, nickel, indium, tin oxide, brass or the like. The substrate may be flexible, seamless, or rigid and can be comprised of various different configurations such as, for example, a plate, a cylindrical drum, a scroll, and the like. The thickness of the substrate layer is dependent on many factors including, for example, the components of the other layers, and the like; generally, however, the substrate is of a thickness of from about 50 microns to about 5,000 microns.

Examples of the components selected for the single layer are as illustrated herein with the preferred charge transfer complex being poly(methylphenyl)silylene and (4-n-butoxycarbonyl-9-fluorenylidene)malononitrile.

The photoconductive imaging member of the present invention in embodiments is believed to function as follows, although it is not desired to be limited by theory. Imaging light in the visible portion of the light spectrum can be absorbed in the charge transfer complex, and free holes and free electrons are thus created in the coating film. When the imaging member is charged to a positive polarity, the substrate possesses negative polarity, image light generated free holes move to the substrate, and free electrons move to the top surface of the charge transfer complex film thereby discharging the charge potential.

The imaging members of the present invention can be selected for electrostatographic, especially xerographic, imaging and printing processes wherein, for example, a positively or negatively charged imaging member is selected, and developing the image with toner comprised of resin, such as styrene acrylates, styrene methacrylates, styrene butadienes, and the like, pigment such as carbon black, and a charge control additive such as distearyl dimethyl ammonium methyl sulfate.

The following Examples, except for any comparative Examples, are being supplied to further define specific embodiments of the present invention, it being noted that these Examples are intended to illustrate and not limit the scope of the present invention. Also, parts and percentages are by weight unless otherwise indicated. A comparative working Example data is also presented.

EXAMPLE I

A photoresponsive imaging member was prepared by providing an aluminized MYLAR® substrate in a thickness of 75 microns, followed by applying thereto with a multiple clearance film applicator a solution of N-methyl-3-aminopropyl-trimethoxy silane (obtained from PCR Research Chemicals) in ethanol (1:20 volume ratio). This hole blocking layer, 0.1 micron, was dried for 5 minutes at room temperature, and then cured for 10 minutes at 110° C. in a forced air oven. There was then applied to the above silane layer a solution of 0.5 percent by weight of 49,000 polyester (obtained from E. I. DuPont Chemical) in a mixture of methylene chloride and 1,1,2-trichloroethane (4:1 volume ratio) with a multiple clearance film applicator. The layer was allowed to dry for one minute at room temperature, and 10 minutes at 100° C. in a forced air oven. The resulting adhesive layer had a dry thickness of 0.05 micron.

A 15 micron thick photoconductive layer comprised of a charge transfer complex of poly(methylphenyl)silylene (PMPS) and (4-n-butoxycarbonyl-9-fluorenylidene)malononitrile (BCMF) was fabricated as follows. One gram of PMPS of a weight average molecular weight of 200,000 and 0.1 gram of BCMF were dissolved by stirring in 100 milliliters of methylene chloride in a 500 milliliter flask. Thereafter, the resulting solution was coated as a film on the adhesive layer with a multiple clearance applicator and dried in a forced air oven at 100° C. for 10 minutes.

The above fabricated imaging member was electrically tested by negatively charging it with a corona, and discharged by exposing it to white light of wavelengths of from 400 to 700 nanometers. Charging was accomplished with a single wire corotron in which the wire was contained in a grounded aluminum channel and was strung between two insulating blocks. The acceptance potential of this imaging member after charging, and its residual potential after exposure were recorded. The procedure was repeated for different exposure energies supplied by a 75 watt Xenon arc lamp of incident radiation, and the exposure energy required to discharge the surface potential of the member to half of its original value was determined. This surface potential was measured using a wire loop probe contained in a shielded cylinder, and placed directly above the photoreceptor member surface. This loop was capacitively coupled to the photoreceptor surface so that the voltage of the wire loop corresponds to the surface potential. Also, the cylinder enclosing the wire loop was connected to the ground.

The above imaging member was negatively charged to a surface potential of 800 volts, and discharged to a residual potential of 15 volts. The energy required to discharge the member from 800 volts to 100 volts was 50 ergs/cm$^2$. The dark decay of this device was about 20 volts/second as measured by monitoring the potential on a probe in the dark for about 15 seconds. Further, the electrical properties of the above prepared photoresponsive imaging member remained essentially unchanged for 2,000 cycles of repeated charging and discharging.

EXAMPLE II

A layered photoresponsive imaging member was fabricated by repeating the procedure of Example I with the exception that the member was charged to a positive polarity of 800 volts, and the member was tested as indicated in Example I, and substantially similar results were obtained.

EXAMPLE III

A layered photoresponsive imaging member was prepared by repeating the procedure of Example I with the exception that the transfer complex was comprised of poly(hexylmethyl)silylene, and substantially similar electrical characteristics were obtained for both negative and positive polarity charging.

EXAMPLE IV

A layered photoresponsive imaging member was prepared by repeating the procedure of Example I with the exceptions that the transfer complex was comprised of poly(methylphenyl)silylene, and the BCMF was replaced with 3,5-dimethyl-3',5'-tertiarybutyl-4,4'-diphenoquinone, and substantially similar electrical characteristics were obtained.

Advantages associated with the imaging members of the present invention in embodiments include ambipolarity, and ecomonical and simple fabrication.

Although the invention has been described with reference to specific preferred embodiments, it is not intended to be limited thereto, rather those skilled in the art will recognize variations and modifications may be made therein which are within the spirit of the invention and within the scope of the following claims.

What is claimed is:

1. An ambipolar photoconductive imaging member consisting essentially of a supporting substrate and in contact with the supporting substrate a charge transfer layer comprised of a polysilylene donor polymer and an electron acceptor, and wherein said electron acceptor is selected from the group consisting of (4-n-butoxycarbonyl-9-fluorenylidene)malononitrile, (4-n-phenethoxycarbonyl-9-fluorenylidene)malononitrile, (4-n-butoxycarbonyl-2,7-dinitro-9-fluorenylidene) malononitrile, 3,5-dimethyl-3',5'-tertiarybutyl-4,4'-diphenoquinone, and 3,5-diethyl-3',5'-tertiarybutyl-4,4'-diphenoquinone.

2. An imaging member in accordance with claim 1 wherein the polysilylene is polymethyl phenyl silylene.

3. An imaging member in accordance with claim 1 wherein the electron acceptor is (4-n-butoxycarbonyl-9-fluorenylidene) malononitrile, and wherein the polysilylene is polymethyl phenyl silylene.

4. An imaging member in accordance with claim 1 wherein the polysilylene is polyhexylmethylsilylene or polydihexylsilylene.

5. A method of imaging which comprises generating an electrostatic image on the imaging member of claim 4; subsequently transferring this image to a suitable substrate; and thereafter permanently affixing the image thereto.

6. An imaging member in accordance with claim 1 wherein the supporting substrate is comprised of a conductive component.

7. An imaging member in accordance with claim 1 wherein the supporting substrate is comprised of a metal.

8. An imaging member in accordance with claim 1 wherein the supporting substrate is comprised of aluminum.

9. An imaging member in accordance with claim 1 which can be charged to a positive or a negative polarity.

10. An imaging member in accordance with claim 9 wherein the positive polarity is from between about 5 to about 50 volts per micron, and the negative polarity is between about 5 to about 50 volts per micron.

11. An imaging member in accordance with claim 1 wherein the thickness of the charge transfer complex layer is from between about 5 to about 40 microns.

12. An imaging member in accordance with claim 1 wherein the thickness of the charge transfer complex layer is from between about 10 to about 20 microns.

13. A photoconductive imaging member in accordance with claim 1 wherein the supporting substrate is comprised of a conductive component on an organic polymeric composition.

14. A method of imaging which comprises generating an electrostatic image on the imaging member of claim 1; subsequently transferring this image to a suitable substrate; and thereafter permanently affixing the image thereto.

15. A photoconductive imaging member in accordance with claim 1 wherein for the charge transfer layer there is selected as the donor polymer poly(methyl phenyl) silylene, poly(n-propylmethylsilylene-co-methylphenylsilylene), poly(methylphenylsilylene-co-dimethylsilylene), poly(cyclohexylmethylsilylene), poly(diphenylsilylene-co-methylphenylsilylene), poly(-cyclotetramethylenesilylene), poly(paratolylmethylsilylene), poly(n-butylmethylsilylene), or poly(n-propylmethylsilylene), and as the electron transporting acceptor (4-n-butoxycarbonyl-9-fluorenylidene)malononitrile, [(4-n-butoxycarbonyl-9-fluorenylidene)malononitrile,] (4-n-phenethoxycarbonyl-9-fluorenylidene)-malononitrile, [(4-carbitoxy-9-fluorenylidene)malononitrile,] (4-n-butoxycarbonyl-2,7-dinitro-9-fluorenylidene) malononitrile, 3,5-dimethyl-3',5'-tertiarybutyl-4,4'-diphenoquinone, or 3,5-diethyl-3',5'-tertiarybutyl-4,4'-diphenoquinone.

16. An ambipolar photoconductive imaging member consisting essentially of a supporting substrate and in contact therewith a single layer which functions as a charge transport and a photogenerating layer which consists essentially of polysilylene donor polymer and an electron acceptor selected from the group consisting of (4-n-butoxycarbonyl-9-fluorenylidene) malononitrile, (4-n-butyoxycarbonyl-9-fluorenylidene) malononitrile, (4-n-phenethoxycarbonyl-9-fluorenylidene) malononitrile, (4-carbitoxy-9-fluorenylidene malononitrile, and (4-n-butoxycarbonyl)-2,7-dinitro-9-fluorenylidene) malononitrile.

17. An imaging member in accordance with claim 16 wherein the polysilylene is polymethyl phenyl silylene and the electron acceptor is (4-n-butoxycarbonyl-9-fluorenylidene) malononitrile.

* * * * *